US005862647A

United States Patent [19]

Scherer et al.

[11] Patent Number: 5,862,647

[45] Date of Patent: Jan. 26, 1999

[54] QUICK THREAD WRAPPING MACHINE STRETCH HEAD AND WRAPPING FILM METHOD

[75] Inventors: Philip G. Scherer, Fort Lauderdale; Kurt E. Engler, Pompano Beach, both of Fla.

[73] Assignee: Mima Incorporated, Glenview, Ill.

[21] Appl. No.: 965,222

[22] Filed: Nov. 6, 1997

[51] Int. Cl.[6] ..... B65B 53/00

[52] U.S. Cl. ..... 53/441; 53/556

[58] Field of Search ..... 53/556, 441

[56] References Cited

U.S. PATENT DOCUMENTS

| | | | |
|---|---|---|---|
| 4,302,920 | 12/1981 | Lancaster et al. | 53/441 X |
| 4,497,159 | 2/1985 | Lancaster | 53/556 |
| 4,914,891 | 4/1990 | Suolahti . | |
| 5,287,678 | 2/1994 | Leitzel | 53/441 X |
| 5,414,979 | 5/1995 | Moore et al. . | |
| 5,447,008 | 9/1995 | Martin-Cocher | 53/441 X |
| 5,477,658 | 12/1995 | Berger et al. | 53/441 X |

*Primary Examiner*—Linda Johnson
*Attorney, Agent, or Firm*—Schwartz & Weinrieb

[57] ABSTRACT

A wrapping machine stretch head comprises a pair of tension rollers having first ends mounted upon a base plate and second ends mounted within separate and independent brackets such that the second ends of the tension rollers are not connected to each other and define an axially open space therebetween. In this manner, when wrapping film is to be threaded or routed between and around the tension rollers, the wrapping film is able to be inserted into the axially open space in an axially oriented mode. The rotary drive system for the tension rollers is also mounted upon the base plate and not within an upper frame member as is characteristic of conventional wrapping machine stretch heads.

20 Claims, 5 Drawing Sheets

QUICK THREAD WRAPPING MACHINE STRETCH HEAD AND WRAPPING FILM METHOD

FIELD OF THE INVENTION

The present invention relates generally to stretch film wrapping machines, and more particularly to a new and improved wrapping machine stretch head comprising a plurality of stretch rollers around which the stretch film is able to be routed or threaded in a quick, easy, and safe manner.

BACKGROUND OF THE INVENTION

Film wrapping machines for wrapping products or articles in wrapping film conventionally comprise a film roll upon which a supply of the wrapping film is disposed, and a plurality of rollers around which the wrapping film is routed so as to have a predetermined amount of tension developed within the film such that the wrapping film exhibits a predetermined or requisite amount of tension required for the film wrapping operation. One conventional type of film wrapping machine comprises a set of rollers fixedly mounted within respective upper and lower frame members whereby, for example, a leading end of the wrapping film must be withdrawn from the film supply roll and manually routed or threaded through and around the set of tension rollers. This process or operation, however, has proven to be very awkward, difficult, and tedious for operator personnel because the film must be threaded or routed beneath the upper frame member and between the tension rollers. Such requirements have additionally manifested themselves in rendering the wrapping film threading or routing process or operation quite time consuming whereby non-productive downtime, attendant for example the exchange of wrapping film supply rolls when a particular wrapping film supply roll which has been depleted is being removed and a new wrapping film supply roll which has a fresh supply of wrapping film thereon is being installed, has been relatively extensive.

In order to improve upon the foregoing conventional type of film wrapping system such that the film threading or routing operation is rendered less awkward, difficult, tedious, and time-consuming, another conventional type of film wrapping system was developed wherein the threading or routing of the wrapping film around the various tension rollers was, in effect, rendered "automatic" due to the presence or relative disposition of, for example, a plurality of fixed film tension rolls and a plurality of relatively movable press rolls. A system of this type is disclosed, for example, within U.S. Pat. No. 4,914,891 which issued to Suolahti on Apr. 10, 1990.

With reference being made to FIG. 1 of the present patent application drawings, which corresponds to FIG. 2 of the drawings of U.S. Pat. No. 4,914,891, the patented system of Suolahti is seen to comprise a pair of vertically oriented film tension rolls 23 which have their upper and lower ends respectively mounted within fixed upper and lower frame plates 22 and 21. A drive motor 27 and transmission means 28 are mounted upon the upper frame plate 22 and are operatively associated with the tension rolls 23. In a similar manner, three vertically oriented press rolls 30 are mounted upon a frame 29 which is pivotally mounted with respect to the frame plates 21 and 22, and the tension rolls 23 thereon, such that the frame 29, and the press rolls 30 thereof, is pivotally movable, as indicated by the arrow, between a closed position, at which the three press rolls 30 are disposed in an interdigitated manner upon opposite sides of, and between, the two tension rolls 23 whereby wrapping film from a wrapping film roll 5 may be properly routed, threaded, or disposed around the tension rolls 23, and an opened position, as illustrated, whereby a depleted wrapping film roll 5 may be removed from the framework comprising upper and lower frame plates 22 and 211, and a new wrapping film roll 5 may be installed in place of the previously depleted wrapping film roll 5. The lower fixed frame plate 21 is provided with a slot 33 within which a bushing 34 of wrapping film roll 5 is accommodated. When the new wrapping film roll 5 is installed within the framework and between the upper and lower frame plates 22 and 21, the film is withdrawn from the film roll 5 and moved across the tension rolls 23 in a direction transverse to the vertically oriented axes of the tension rolls 23.

Another system similar to that of Suolahti is disclosed within U.S. Pat. No. 5,414,979 which issued to Moore et al. on May 16, 1995. This patented system is likewise seen to comprise, as illustrated in FIG. 2 of the present patent application drawings which corresponds to FIG. 1 of the drawings of the noted patent to Moore et al., a first dispenser frame assembly 26 upon which is mounted a pair of vertically oriented upstream and downstream prestretch rollers 36 and 40, an orienting roller 80, and a spindle 30 for supporting a roll 32 of stretch wrap packaging material 14. The system further comprises a second dispenser frame assembly 50 upon which an intermediate orienting roller 52, and orienting rollers 82 and 84, are mounted for cooperating with the prestretch rollers 36 and 40, and the orienting roller 80, of the first dispenser frame assembly 26 in an interdigitated manner as illustrated. The second dispenser frame assembly 50 is pivotally mounted relative to the first dispenser frame assembly 26 by means of a hinge mechanism 56 such that, for example, the second dispenser frame assembly 50 can be moved between opened and closed positions relative to the first dispenser frame assembly 26 in connection with the threading or routing of the packaging material 14 from the supply roll 32 when a new supply roll 32 of film or packaging material 14 is installed and wherein the film or packaging material 14 is to be properly tensioned. As was the case with the patented system of Suolahti, the film or packaging material 14 is withdrawn from supply roll 32 and moved across prestretch rollers 36 and 40, and orienting roller 80, in a direction transverse to the respective vertically oriented axes of the rollers 36, 40, and 80.

While it may therefore be appreciated that the systems of Suolahti and Moore et al. comprise improvements over the prior systems, wherein manual threading or routing of the packaging or wrapping film between and around the various tension or prestretch rollers and the press or orienting rollers was required, in that the threading or routing of the packaging or wrapping film was rendered substantially easier in view of the opening of the roller system by means of the movement of the press rollers or the orienting rollers away from the tension rollers or prestretch rollers, such systems of Moore et al. and Suolahti nevertheless present operational problems or drawbacks in view of the fact that attendant a supply film replacement or replenishment operation, the movable frame assemblies must be operated between their opened and closed positions in order to permit the new supply of wrapping or packaging film to be inserted, routed, or threaded between the various rollers. Such movements of the movable frame dispenser or assembly are therefore still time-consuming in view of the necessary opening and closing operations, and in addition, such operations still result in non-productive downtime.

A need therefore exists in the art for a new and improved film packaging or wrapping machine stretch head, station, or dispenser wherein the routing or threading of the film or packaging material is facilitated in a readily quick and simple manner, and wherein further, in the interest of production economy, the moving components of such prior art stretch head, station, or dispenser are able to be eliminated.

OBJECTS OF THE INVENTION

Accordingly, it is an object of the present invention to provide a new and improved film packaging or wrapping machine stretch head.

Another object of the present invention is to provide a new and improved film packaging or wrapping machine stretch head which effectively eliminates or overcomes the various operational disadvantages or drawbacks characteristic of the known or conventional film packaging or wrapping machines.

A further object of the present invention is to provide a new and improved film packaging or wrapping machine stretch head wherein, in lieu of the conventional manual routing or threading of the film packaging or wrapping material, or in lieu of the conventional "automatic" routing or threading of the film packaging or wrapping material in a direction transverse to the axes of the prestretch or tension rollers as permitted by means of the opened frameworks of the aforenoted prior art machinery or equipment, the film or packaging material is able to be quickly and easily routed or threaded between the various rollers of the stretch head, without the need for movable, opened and closed framework components, by being inserted in a direction which is parallel to the axes of the prestretch or tension rollers in view of the fact that the drive mechanism or components for the prestretch or tension rollers are disposed within one end of the apparatus or equipment framework, and the other end or region of the apparatus or equipment framework is open so as to permit the packaging film or material to be inserted between the various prestretch or tension rollers in an axial manner.

SUMMARY OF THE INVENTION

The foregoing and other objectives are achieved in accordance with the principles and teachings of the present invention through the provision of a wrapping machine stretch head wherein the driving system for the stretch rollers or tension rolls is provided within a first end or bottom region of the stretch head, and second or upper ends of the tension rolls or stretch rollers are mounted or secured within independent support or mounting brackets.

In this manner, the second ends of the tension rolls or stretch rollers are not connected to each other, the second ends of the tension rolls or stretch rollers are spaced from each other so as to permit the wrapping film to be threaded or routed therebetween, and the second end of the stretch head is effectively open so as to permit the wrapping film to be easily, quickly, and simply inserted in an axial mode between the tension rolls or stretch rollers. As a result, the awkward, difficult, and tedious threading or routing of the wrapping film beneath the upper frame member and between the tension rolls or stretch rollers, in a direction which is substantially transverse to the longitudinal axes of the tension rolls or stretch rollers, is effectively obviated. In addition, the relative arrangement or disposition of the various structural components of the stretch head of the present invention also effectively eliminates the need for mounting the tension rolls or stretch rollers, or associated press rolls or orienting rollers, upon pivotally movable frame members, as was characteristic of the aforenoted prior art systems, which are movable between open and closed positions in order to permit operator personnel to thread or route the wrapping film between the tension rolls or stretch rollers attendant an exchange of wrapping film supply rolls and which present production downtime drawbacks.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 3:
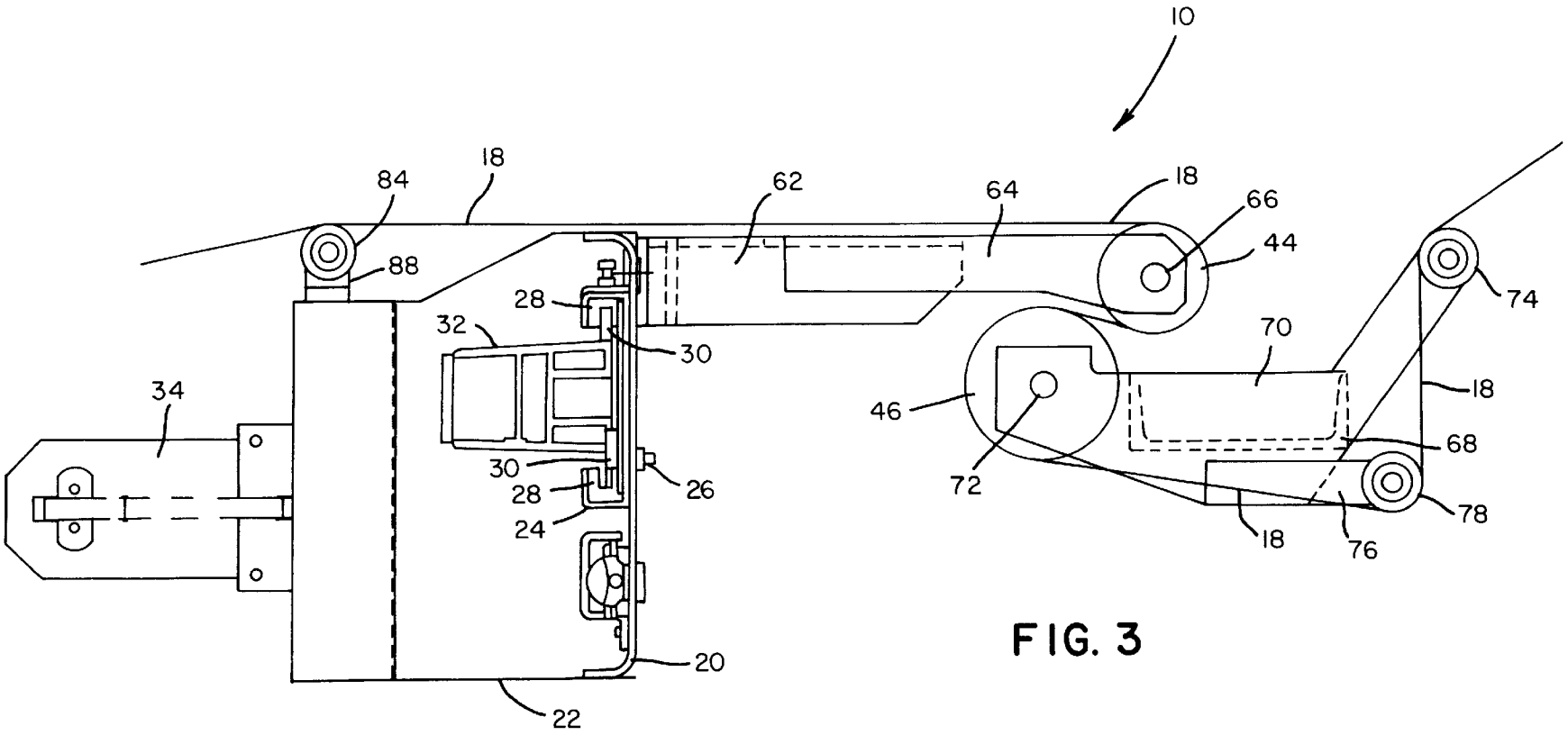
FIG. 3 is a top plan view of the new and improved quick thread wrapping machine stretch head constructed in accordance with the principles and teachings of the present invention and showing the cooperative parts thereof.
Figure 4:
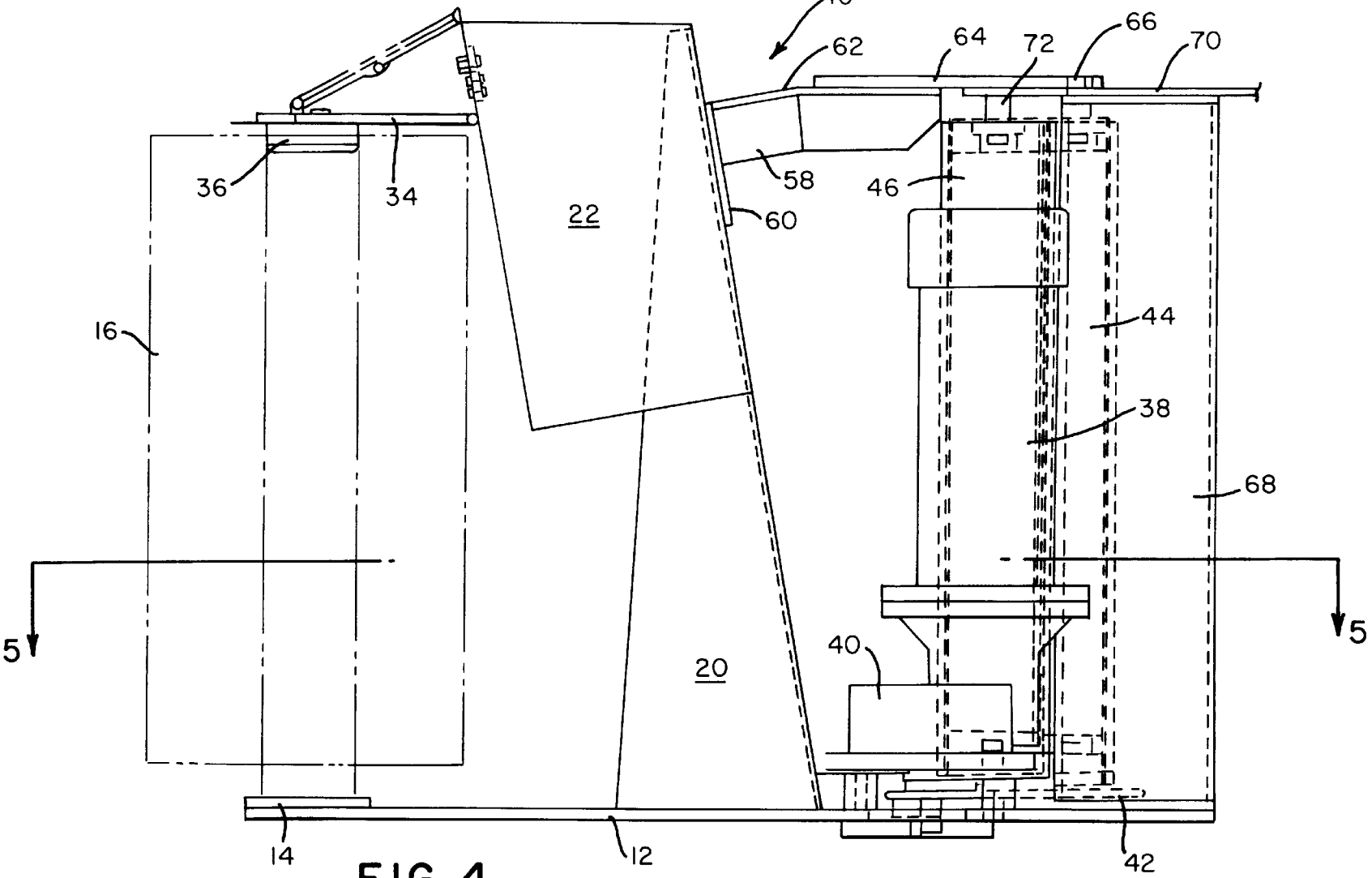
FIG. 4 is a side elevation view of the new and improved quick thread wrapping machine stretch head of the present invention and corresponding essentially to the stretch head of FIG. 3.
Figure 5:
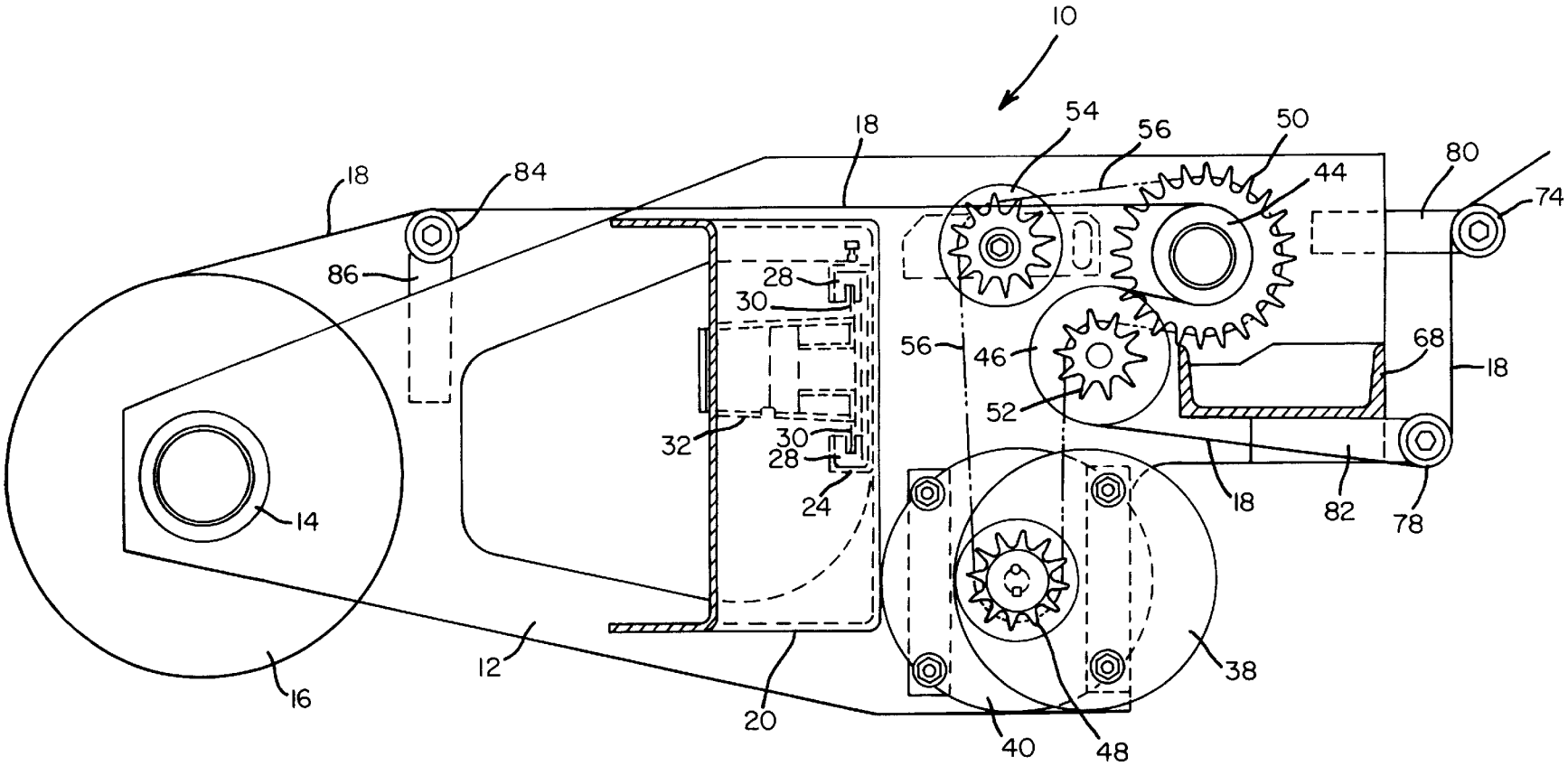
FIG. 5 is a cross-sectional view of the new and improved quick thread wrapping machine stretch head as shown in FIG. 4 as taken along the line 5—5 of FIG. 4.

Referring now to the drawings, and more particularly to FIGS. 3–5 thereof, the new and improved quick thread wrapping machine stretch head constructed in accordance with the principles and teachings of the present invention is illustrated and generally indicated by the reference character 10. The stretch head 10 is seen to comprise a base plate 12, as best seen in FIGS. 4 and 5, upon one end of which a lower bearing member 14 is mounted so as to rotatably support a substantially upstanding or vertically oriented wrapping film supply roll 16 from which a fresh supply of wrapping film 18 is able to be withdrawn in connection with the performance of a package, article, or pallet wrapping operation.

A substantially upstanding or vertically oriented main support frame 20 projects upwardly from a substantially central portion of the base plate 12, and a steel sheet form or housing 22 is integrally fixed to and carried by the main support frame 20. A support bracket 24, having a substantially reversely or backwardly oriented C-shaped configuration, is affixed to the main support frame 20 by suitable means, such as, for example, bolt fasteners 26, and the opposite ends of the support bracket 24 form slotted rails 28 for accommodating flanged ends 30 of a vertically oriented downright or support mast structure 32 upon which the entire stretch head 10 is vertically reciprocable attendant a film wrapping operation. The steel sheet form or housing 22 is provided with an upper support bracket 34 which has an upper bearing member 36 mounted thereon for engaging the upper end of the wrapping film supply roll 16 and for cooperating with the lower bearing member 14 in rotatably supporting the wrapping film supply roll 16.

Figure 1:
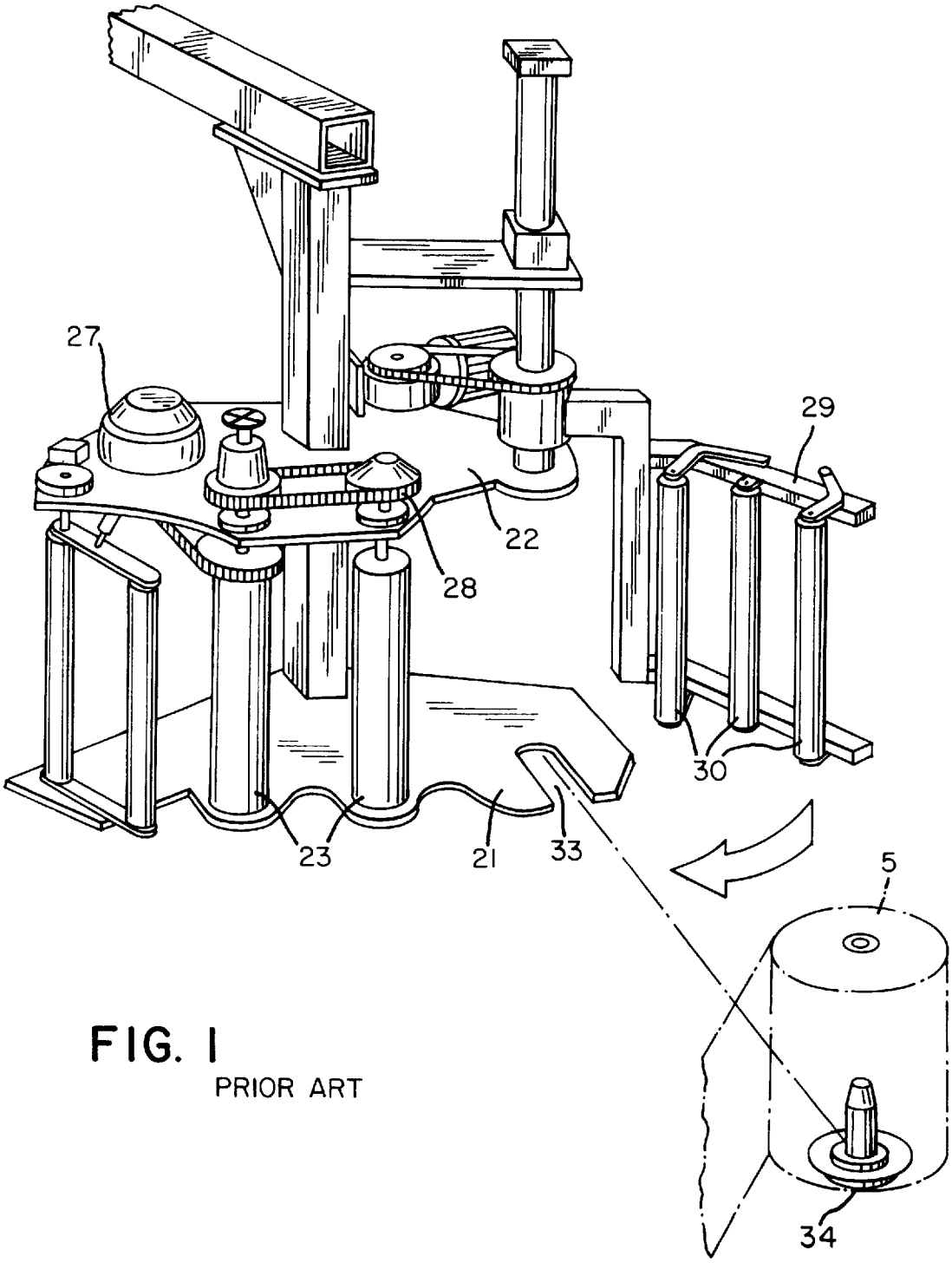
FIG. 1 PRIOR ART
FIG. 1 is a perspective, partially exploded, view of an exemplary wrapping film tension roll system characteristic of the known PRIOR ART and as disclosed within U.S. Pat. No. 4,914,891.
Figure 2:
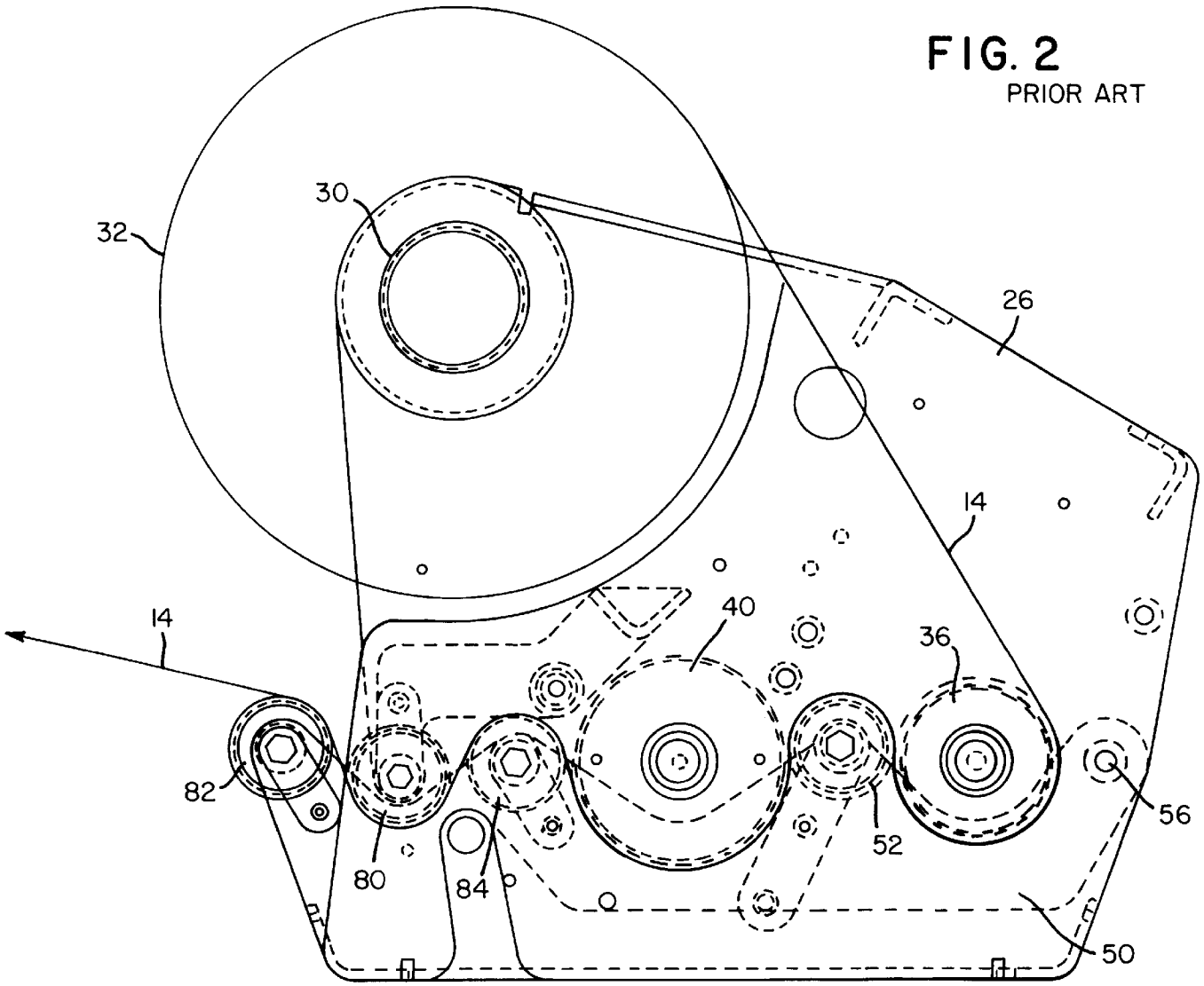
FIG. 2 PRIOR ART
FIG. 2 is a top plan view of another exemplary wrapping film tension roll system characteristic of the known PRIOR ART and as disclosed within U.S. Pat. No. 5,415,979.

Contrary to conventional wrapping machine stretch heads wherein, for example, the rotary drive for the tension rolls or stretch rollers is mounted upon an upper support frame or plate member, as exemplified at 27 and 28, for example, as disclosed in FIG. 1 of the drawings which corresponds to FIG. 2 of the aforenoted Suolahti patent, the quick thread wrapping machine stretch head of the present invention has the rotary drive means thereof located at the bottom of the stretch head, and the upper ends of the tension rolls or stretch rollers are not connected to each other by, for example, an upper frame member as is characteristic of the known prior art systems.

More particularly, as best seen from FIGS. 4 and 5, the opposite end of the base plate 12 of the stretch head 10 has a substantially vertically oriented drive motor 38 mounted thereon, as well as a gear box 40, and the drive motor 38 and the gear box 40 are drivingly interconnected together by means of suitable gearing 42. At the rear of the base plate 12, there is provided a first tension roll or stretch roller 44 which extends substantially vertically upwardly from the base plate 12 and which has a relatively small diametrical extent, and there is also provided a second stretch roller or tension roll 46 which likewise extends substantially vertically upwardly from the base plate 12 and which has a relatively large diametrical extent. The gear box 40 is provided at its base end with a suitable output gear or sprocket wheel 48, as best seen in FIG. 5, and the first, relatively small tension roll or stretch roller 44 and the second, relatively large tension roll or stretch roller 46 are respectively provided at their base ends with relatively large and small sprocket gears or wheels 50 and 52. An idler gear or sprocket wheel 54 is also mounted upon the base plate 12, and an endless sprocket chain 56 is routed around the gear box sprocket wheel 48, the tension roll or stretch roller sprocket wheels 50 and 52, and the idler sprocket wheel 54 such that rotary drive is transmitted from the motor 38 to the gear box 40, and in turn, from the gear box 40 to the idler gear or sprocket wheel 54 and the tension roll or stretch rollers sprocket wheels or gears 50 and 52 so as to rotatably drive the tension rolls or stretch rollers 44 and 46.

As can be further appreciated from FIG. 5, the wrapping film 18 from wrapping film supply roll 16 is routed around the exterior surfaces of the tension rolls or stretch rollers 46 in a pattern having a substantially reversed S-shaped configuration, and in view of the difference in the diametrical extents of the tension rolls or stretch rollers 44 and 46, and their associated sprocket wheels or gears 50 and 52, the wrapping film 18 is stretched to a predeterminedly desired degree. It is also to be noted that the film path around the tension rolls or stretch rollers 44 and 46, having the substantially reversed S-shaped configuration, is contrary to the film path or pattern around the tension rolls or stretch rollers of the prior art exemplified by Suolahti and Moore et al. wherein the film paths or patterns of such known prior art comprise a substantially W-shaped configuration. The substantially S-shaped film path or pattern characteristic of the present invention provides the wrapping film with better desirable characteristics, such as, for example, tensile strength or the like, while eliminating or minimizing undesirable characteristics, such as, for example, wrapping film neckdown.

In order to fixedly mount or secure the upper ends of the tension rolls or stretch rollers 44 and 46 with respect to the stretch head 10, an angle iron 58 is provided within the upper region of the stretch head 10 and is seen to comprise a first leg portion 60 which is adapted to be fixedly secured to the main support frame 20 by suitable means, such as, for example, bolt fasteners, not shown, and a second leg portion 62 integral with the first leg portion 60 and to which one end of a first support bracket 64 is secured by suitable means, such as, for example, bolt fasteners, also not shown. The opposite end of the support bracket 64 is provided with a suitable rotary bearing 66 within or by means of which the upper end of the small tension roll or stretch roller 44 is rotatably mounted, all as best appreciated from FIGS. 3 and 4.

In a somewhat similar manner, as may additionally be appreciated from FIG. 5, a substantially vertical upstanding frame member 68, having a substantially C-shaped cross-sectional configuration, is fixedly secured at its lower end to the base plate 12, and the upper end of the frame member 68 has a second support bracket 70 fixedly secured thereto as best seen in FIG. 3. One end of the second support bracket 70 is provided with a rotary bearing member 72 for rotatably supporting the upper end of the large tension roll or stretch roller 46, and the other opposite end of the second support bracket 70 rotatably supports and mounts the upper end of a first idler roller 74 around which the wrapping film 18 is conducted when the wrapping film 18 is being transported toward a wrapping station, not shown, at which an article, package, or pallet, is disposed so as to be wrapped. A third support bracket 76 is fixedly secured to the second support bracket 70 by suitable means, such as, for example, bolt fasteners, not shown, so as to rotatably support the upper end of a second idler roller 78 around which the wrapping film 18 is also conducted, the second idler roller 78 being located along the wrapping film path so as to be interposed between the large tension roll or stretch roller 46 and the first idler roller 74.

As best seen in FIG. 5, fourth and fifth support brackets 80 and 82 are respectively secured by suitable means, such as, for example, bolt fasteners, not shown, to the base plate 12 so as to respectively rotatably support the lower ends of the first and second idler rollers 74 and 78. As best appreciated from FIGS. 3 and 5, a third idler roller 84 is provided along the wrapping film path so as to be interposed between the wrapping film supply roll 16 and the first small tension roll or stretch roller 44, and sixth and seventh support brackets 86 and 88 are respectively secured by suitable means, such as, for example, bolt fasteners, not shown, to the base plate 12 and the steel sheet form or housing 22 so as to rotatably support the lower and upper ends of the third idler roller 84.

In utilizing the wrapping film wrapping machine stretch head apparatus or system 10 of the present invention, particularly when a new or fresh supply roll 16 of the wrapping film 18 has been installed upon the stretch head 10, the leading end of the wrapping film 18 is withdrawn from the film supply roll 16, routed around the idler roller 84, and conducted toward the tension rolls or stretch rollers 44 and 46. In view of the fact that the upper ends of the tension rolls or stretch rollers 44 and 46 are respectively rotatably mounted within the mounting or support brackets 64 and 70 which are separate and independent from each other so as not to be connected to each other, such as, for example, by means of upper frame members or the like similar to those characteristic of the known prior art as disclosed within, for example, the aforenoted Suolahti and Moore et al. patents, the upper end of the stretch head 10 of the present invention, particularly within the region or vicinity of the tension rolls or stretch rollers 44 and 46, is effectively open.

In view of the additional fact that the tension rolls or stretch rollers 44 and 46 are laterally spaced from each other, the leading end of the wrapping film 18 may be partially routed around the small tension roll or stretch roller 44, subsequently readily and easily inserted between the tension rolls or stretch rollers 44 and 46 in a substantially vertically downward mode within the space defined between the tension rolls or stretch rollers 44 and 46 and in a direction parallel to the longitudinal axes of the tension rolls or stretch rollers 44 and 46, and routed around the large tension roll or stretch roller 46 so as to be conducted further downstream toward the idler rollers 78 and 74.

As can therefore be appreciated, in view of the fact that the upper region of the stretch head 10, particularly within the vicinity of the tension rolls or stretch rollers 44 and 46, is open and not closed or covered by means of an upper frame member as is characteristic of the known prior art such as that of Suolahti and Moore et al., the wrapping film 18 can be inserted between and routed around the tension rolls or stretch rollers 44 and 46 in a substantially vertically downward mode or axial direction, and the need for movable doors or frame members, upon which tension rolls, press rolls, or orienting rolls are mounted, and by means of which the wrapping film is inserted in a relatively transverse direction with respect to the longitudinal or axial extents of the tension rolls or stretch rollers, is obviated. In addition, the awkward, difficult, tedious, and time-consuming film threading operations, likewise characteristic of the prior art systems, are also effectively eliminated.

It is to be noted that while the upper region of the stretch head 10 of the wrapping machine of the present invention is to be open, as defined between the upper ends of the tension rolls or stretch rollers 44 and 46, and their respective support brackets 64 and 70, during a wrapping film threading or routing operation attendant, for example, the installation of a new wrapping film supply roll 16, so as to in fact permit the substantially vertically downward insertion of the leading end of the wrapping film 18 into and within the space defined between the tension rolls or stretch rollers 44 and 46, during running of the wrapping film 18 attendant an actual packaging or wrapping operation with respect to an article, package, or pallet being wrapped, and wherein, for example, a relatively heavy gauge wrapping film 18 may be employed, the respective upper ends of the tension rolls or stretch rollers 44 and 46 may tend to move toward each other under the forces of the wrapping film 18 which may be impressed thereon.

Under the aforenoted operating conditions, the upper ends of the tension rolls or stretch rollers 44 and 46 may be provided with a suitable mechanical stabilizer, spacer, or the like so as to structurally maintain the stretch rollers or tension rolls 44 and 46 at their relative dispositions with respect to each other. Such a stabilizer, spacer, or the like would of course be movable between a first inoperative position at which the upper ends of the tension rolls or stretch rollers 44 and 46 would no longer be mechanically connected together whereby the upper end of the stretch head 10 would in effect be open so as to permit the vertically downward or axial threading of the wrapping film 18 between the tension rolls or stretch rollers 44 and 46, and a second operative position at which the upper ends of the tension rolls or stretch rollers 44 and 46 would be connected together so as to maintain the tension rolls or stretch rollers 44 and 46 at their desired positions predeterminedly spaced from each other.

It is to be lastly noted that the longitudinal extent or axis of the steel sheet form or housing 22 is oriented vertically while the base plate 12 is disposed at a predetermined angle with respect to the horizontal so as to permit the wrapping film 18, which is therefore being discharged at a relatively downward or inclined angle, to reach the lowermost elevational levels at the wrapping station, not shown, in order to be capable of wrapping, for example, palletized loads. If the base plate 12 was oriented horizontally, the wrapping film 18 would not be able to be disposed at the lowermost elevational levels relative to the wrapping station and the particular load to be wrapped due to the disposition of the other structural components of the stretch head system, such as, for example, the downright structure upon which the stretch head 10 is vertically reciprocable, the provision of the rotary drive components, that is, the motor 38, the gear-box 40, and the sprocket wheels 48, 50, 52, 54, and the like, within the lower region or bottom end of the stretch head 10.

Thus it may be seen that the wrapping machine stretch head of the present invention overcomes the various operational and safety drawbacks and disadvantages of the known prior art systems. By locating the rotary drive means for the tension rolls or stretch rollers within the bottom or lower end region of the stretch head, thereby eliminating the need for an upper support frame member for the rotary drive system, and by fixedly mounting the upper ends of the tension rolls or stretch rollers within separate and independent support brackets whereby the upper ends of the tension rolls or stretch rollers are not connected to each other, the wrapping film may be readily and easily inserted, into the space defined between the tension rolls or stretch rollers, in a substantially vertically downward or axial mode parallel to the longitudinal axes of the tension rolls or stretch rollers. In this manner, the awkward, difficult, tedious, and time-consuming threading or routing of the wrapping film beneath the upper frame member and between the tension rolls or stretch rollers is eliminated, as is the need for movable frame members, upon which cooperating press or orienting rolls are mounted, which open and close with respect to the tension rolls or stretch rollers so as to conventionally permit the wrapping film to be inserted, routed, or threaded in a direction transverse to the longitudinal axes of the tension rolls or stretch rollers.

It is to be lastly noted that while references may have been made throughout the specification to a particular orientation of the system components as comprising, for example, top, bottom, upper, lower, and the like, it is to be understood that in accordance with the principles and teachings of the present invention, the various components may be oriented differently than as specifically described, although the relative orientation or disposition of the various components with respect to each other will remain the same.

Obviously, many modifications and variations of the present invention are possible in light of the above teachings. It is therefore to be understood that within the scope of the appended claims, the present invention may be practiced otherwise than as specifically described herein.

What is claimed as new and desired to be secured by Letters Patent of the United States of America is:

1. A wrapping machine stretch head, comprising:

a base plate;

support means mounted upon said base plate;

a supply roll of wrapping film;

a first tension roller having first and second ends defining a longitudinal roller axis therebetween, and wherein said first end of said first tension roller is rotatably mounted upon said base plate;

a second tension roller having first and second ends defining a longitudinal roller axis therebetween, wherein said first end of said second tension roller is rotatably mounted upon said base plate, and wherein said second tension roller is adapted to cooperate with said first tension roller so as to define with said first tension roller a space therebetween which is disposed within a first plane and through which a portion of said wrapping film, when withdrawn from said supply roll of wrapping film, can pass whereby a predetermined amount of tension is developed within said wrapping film when said wrapping film is withdrawn from said supply roll of wrapping film and routed around said first and second tension rollers;

first securing means, extending only substantially within a second plane which is substantially parallel to said first plane within which said space defined between said first and second tension rollers is disposed, for fixedly securing said second end of said first tension roller to said support means; and second securing means, extending only substantially within a third plane which is substantially parallel to said first plane within which said space defined between said first and second tension rollers is disposed, and said second plane within which said first securing means is disposed, for fixedly securing said second end of said second tension roller to said support means and for cooperating with said first securing means so as to define a channel, between said first and second securing means, which is open upon opposite sides of said space defined between said first and second tension rollers such that an axially open space is defined between said second ends of said first and second tension rollers and between said first and second securing means so as to permit said wrapping film, withdrawn from said supply roll of wrapping film, to be inserted between said first and second tension rollers in an axial direction within said channel and said first plane, substantially parallel to said longitudinal axes of said first and second tension rollers and to said second and third planes, and which extends from an axial position commencing beyond said second ends of said first and second tension rollers, through said space defined between said first and second tension rollers, and toward said first ends of said first and second tension rollers rotatable mounted upon said base plate.

2. A wrapping machine stretch head as set forth in claim 1, further comprising:

rotary drive means rotatably mounted upon said base plate for rotatably driving said first and second tension rollers.

3. A wrapping machine stretch head as set forth in claim 2, wherein said rotary drive means comprises:

a motor;

a plurality of sprocket wheels wherein one of said sprocket wheels is operatively connected to said motor so as to be driven thereby; and a sprocket wheel chain operatively interconnecting other ones of said plurality of sprocket wheels to said one of said sprocket wheels.

4. A wrapping machine stretch head as set forth in claim 1, wherein:

said support means comprises a first, substantially vertically extending frame member secured to said base plate at a first location and to which said second end of said first tension roller is fixedly secured, and a second, substantially vertically extending frame member secured to said base plate at a second location and to which said second end of said second tension roller is fixedly secured.

5. A wrapping machine stretch head as set forth in claim 4, wherein:

said first and second means respectively fixedly securing said second ends of said first and second tension rollers to said first and second frame members comprise first and second bracket members.

6. A wrapping machine stretch head as set forth in claim 4, further comprising:

housing means fixedly mounted upon said first frame member for accommodating a vertically extending downright of said wrapping machine so as to permit said stretch head to be raised and lowered in a vertical mode whereby said wrapping film may be applied to an object to be wrapped in said wrapping film.

7. A wrapping machine as set forth in claim 1, further comprising:

means for mounting said supply roll of wrapping film upon said base plate.

8. A wrapping machine stretch head, comprising:

a base plate;

support means mounted upon said base plate;

a supply roll of wrapping film;

a first tension roller having first and second ends defining a longitudinal roller axis therebetween, and wherein said first end of said first tension roller is rotatably mounted upon said base plate;

a second tension roller having first and second ends defining a longitudinal roller axis therebetween, wherein said first end of said second tension roller is rotatably mounted upon said base plate, and wherein said second tension roller is adapted to cooperate with said first tension roller so as to define with said first tension roller a space therebetween through which a portion of said wrapping film, when withdrawn from said supply roll of wrapping film, can pass whereby a predetermined amount of tension is developed within said wrapping film when said wrapping film is withdrawn from said supply roll of wrapping film and routed around said first and second tension rollers;

rotary drive means rotatably mounted upon said base plate for rotatably driving said first and second tension rollers;

first securing means for fixedly securing said second end of said first tension roller to said support means; and second securing means for fixedly securing said second end of said second tension roller to said support means and for cooperating with said first securing means so as to define a channel, between said first and second securing means, which is open upon opposite sides of said space defined between said first and second tension rollers such that an axially open space is defined between said second ends of said first and second tension rollers so as to permit said wrapping film, withdrawn from said supply roll of wrapping film, to be inserted between said first and second tension rollers in an axial direction which is disposed parallel to said longitudinal axes of said first and second tension rollers and which extends from an axial position commencing beyond said second ends of said first and second tension rollers, through said space defined between said first and second tension rollers, and toward said first ends of said first and second tension rollers rotatable mounted upon said base plate.

9. A wrapping machine stretch head as set forth in claim 8, wherein said rotary drive means comprises:

a motor;

a plurality of sprocket wheels wherein one of said sprocket wheels is operatively connected to said motor so as to be driven thereby; and a sprocket wheel chain operatively interconnecting other ones of said plurality of sprocket wheels to said one of said sprocket wheels.

10. A wrapping machine stretch head as set forth in claim 8, wherein:

said support means comprises a first, substantially vertically extending frame member secured to said base plate at a first location and to which said second end of said first tension roller is fixedly secured, and a second, substantially vertically extending frame member secured to said base plate at a second location and to which said second end of said second tension roller is fixedly secured.

11. A wrapping machine stretch head as set forth in claim 10, wherein:

said first and second means respectively fixedly securing said second ends of said first and second tension rollers to said first and second frame members comprise first and second bracket members.

12. A wrapping machine stretch head as set forth in claim 10, further comprising:

housing means fixedly mounted upon said first frame member for accommodating a vertically extending downright of said wrapping machine so as to permit said stretch head to be raised and lowered in a vertical mode whereby said wrapping film may be applied to an object to be wrapped in said wrapping film.

13. A wrapping machine stretch head as set forth in claim 8, further comprising:

means for mounting said supply roll of wrapping film upon said base plate.

14. A wrapping machine stretch head as set forth in claim 9, wherein:

said first tension roller is disposed upstream of said second tension roller, as considered in the direction of withdrawal of said wrapping film from said supply roll of wrapping film, and has a smaller diametrical extent than the diametrical extent of said second tension roller; and said plurality of sprocket wheels comprises first and second sprocket wheels respectively operatively connected to said first and second tension rollers wherein said first sprocket wheel operatively connected to said first tension roller has a larger diametrical extent than said second sprocket wheel operatively connected to said second tension roller so as to develop said predetermined amount of tension within said wrapping film.

15. A wrapping machine stretch head as set forth in claim 3, wherein:

said first tension roller is disposed upstream of said second tension roller, as considered in the direction of withdrawal of said wrapping film from said supply roll of wrapping film, and has a smaller diametrical extent than the diametrical extent of said second tension roller; and said plurality of sprocket wheels comprises first and second sprocket wheels respectively operatively connected to said first and second tension rollers wherein said first sprocket wheel operatively connected to said first tension roller has a larger diametrical extent than said second sprocket wheel operatively connected to said second tension roller so as to develop said predetermined amount of tension within said wrapping film.

16. A method of threading a wrapping film, withdrawn from a supply roll of wrapping film, between and around a set of tension rollers disposed upon a stretch head, comprising the steps of:

providing a base plate;

mounting support means upon said base plate;

providing a supply roll of wrapping film;

rotatably mounting a first tension roller, having first and second ends defining a longitudinal roller axis therebetween, upon said base plate;

rotatably mounting a second tension roller, having first and second ends defining a longitudinal roller axis therebetween, upon said base plate such that said second tension roller is adapted to cooperate with said first tension roller so as to develop a predetermined amount of tension within wrapping film withdrawn from said supply roll of wrapping film and routed around said first and second tension rollers;

providing first means for fixedly securing said second end of said first tension roller to said support means;

providing second means for fixedly securing said second end of said second tension roller to said support means such that an axially open space is defined between said second ends of said first and second tension rollers when wrapping film is to be inserted between said first and second tension rollers;

withdrawing a supply of wrapping film from said supply roll of wrapping film; and manually threading said supply of wrapping film, withdrawn from said supply roll of wrapping film, into said axially open space defined between said second ends of said first and second tension rollers and in a substantially axial direction parallel to said longitudinal axes of said first and second tension rollers such that said wrapping film may be routed around said first and second tension rollers.

17. The method as set forth in claim 16, wherein:

said first and second tension rollers are mounted upon said base plate in such a manner that, when said wrapping film is threaded between said first and second tension rollers and routed around said first and second tension rollers, said wrapping film has a substantially S-shaped configuration.

18. The method as set forth in claim 16, further comprising the step of:

mounting rotary drive means upon said base plate for rotatably driving said first and second tension rollers.

19. The method as set forth in claim 18, wherein said step of mounting said rotary drive means upon said base plate further comprises the steps of:

mounting a drive motor upon said base plate;

mounting a drive sprocket wheel, operatively engaged with said drive motor, upon said base plate;

providing said first and second tension rollers with first and second sprocket wheels; and providing an endless sprocket chain around said drive sprocket wheel and said first and second sprocket wheels of said first and second tension rollers such that operation of said drive motor drives said drive sprocket wheel, and said drive sprocket wheel drives said first and second sprocket wheels of said first and second tension rollers by means of said endless sprocket chain.

20. The method as set forth in claim 19, further comprising the steps of:

providing said first tension roller, which is disposed upstream of said second tension roller as considered in the direction of withdrawal of said wrapping film from said supply roll of wrapping film, with a smaller diametrical extent than the diametrical extent of said second tension roller, and providing said first sprocket wheel of said first tension roller with a larger diametrical extent than the diametrical extent of said second sprocket wheel of said second tension roller such that a predetermined amount of stretch is imparted to said wrapping film by said first and second tension rollers.

* * * * *